US008015706B2

(12) United States Patent
Markarian et al.

(10) Patent No.: US 8,015,706 B2
(45) **Date of Patent: *Sep. 13, 2011**

(54) GAS TURBINE FLOATING COLLAR

(76) Inventors: Lorin Markarian, Etobicoke (CA); Bhawan Bhai Patel, Mississauga (CA)

( * ) Notice: Subject to any disclaimer, the term of this patent is extended or adjusted under 35 U.S.C. 154(b) by 295 days.

This patent is subject to a terminal disclaimer.

(21) Appl. No.: 11/548,485

(22) Filed: Oct. 11, 2006

(65) Prior Publication Data

US 2007/0261409 A1 Nov. 15, 2007

Related U.S. Application Data

(62) Division of application No. 10/924,209, filed on Aug. 24, 2004, now Pat. No. 7,140,189.

(51) Int. Cl.
*B21D 53/00* (2006.01)

(52) U.S. Cl. ..... 29/890.01; 60/800

(58) Field of Classification Search ..... 29/890.01; 60/796, 799, 740, 748
See application file for complete search history.

(56) References Cited

U.S. PATENT DOCUMENTS

| | | | | |
|---|---|---|---|---|
| 3,939,653 | A | 2/1976 | Schirmer | |
| 4,322,945 | A | 4/1982 | Peterson et al. | |
| 4,365,470 | A | 12/1982 | Matthews et al. | |
| 4,454,711 | A | 6/1984 | Ben-Porat | |
| 4,606,190 | A | 8/1986 | Greene et al. | |
| 4,686,823 | A | 8/1987 | Coburn et al. | |
| 4,688,310 | A * | 8/1987 | Kelm et al. | 29/889.22 |
| 4,748,806 | A | 6/1988 | Drobny | |
| 4,821,522 | A * | 4/1989 | Matthews et al. | 60/757 |
| 4,999,996 | A | 3/1991 | Duchene et al. | |
| 5,117,624 | A | 6/1992 | Roberts, Jr. et al. | |
| 5,220,786 | A | 6/1993 | Campbell | |
| 5,222,358 | A | 6/1993 | Chaput et al. | |
| 5,253,471 | A | 10/1993 | Richardson | |
| 5,265,409 | A | 11/1993 | Smith, Jr. et al. | |
| 5,271,219 | A | 12/1993 | Richardson | |
| 5,274,991 | A | 1/1994 | Fitts | |
| 5,323,601 | A | 6/1994 | Jarrell et al. | |
| 5,435,139 | A | 7/1995 | Pidcock et al. | |
| 5,501,071 | A | 3/1996 | Ansart et al. | |
| 5,509,270 | A | 4/1996 | Pearce et al. | |
| 5,758,503 | A | 6/1998 | DuBell et al. | |
| 5,894,732 | A | 4/1999 | Kwan | |
| 5,916,142 | A | 6/1999 | Snyder et al. | |
| 5,924,288 | A | 7/1999 | Fortuna et al. | |
| 5,974,805 | A | 11/1999 | Allen | |
| 5,996,335 | A | 12/1999 | Ebel | |
| 6,021,570 | A * | 2/2000 | Lockyer et al. | 29/890.01 |
| 6,351,949 | B1 | 3/2002 | Rice et al. | |
| 6,427,435 | B1 | 8/2002 | Patterson et al. | |
| 6,453,675 | B1 | 9/2002 | Royle | |
| 6,497,105 | B1 * | 12/2002 | Stastny | 60/796 |
| 6,735,950 | B1 * | 5/2004 | Howell et al. | 60/748 |
| 7,134,286 | B2 * | 11/2006 | Markarian et al. | 60/796 |

* cited by examiner

*Primary Examiner* — Rick K Chang
(74) *Attorney, Agent, or Firm* — Norton Rose OR LLP

(57) ABSTRACT

A method of providing a floating collar for a gas turbine engine combustor is provided, and comprises providing an annular sheet metal blank and bending the blank to provide the floating collar with an axial extending annular collar portion, an annular flange portion extending radially from the collar portion and a smooth transition portion between the collar and flange portions. The arrangement offers reduced cost, and simplicity, and therefore facilitates manufacturing.

5 Claims, 4 Drawing Sheets

GAS TURBINE FLOATING COLLAR

CROSS-REFERENCE TO RELATED APPLICATIONS

This application is a divisional of U.S. patent application Ser. No. 10/924,209 filed Aug. 24, 2004, now U.S. Pat. No. 7,140,189, which itself relates to U.S. patent application Ser. No. 10/924,208 also filed Aug. 24, 2004, the entire specifications both of which are incorporated herein by reference.

TECHNICAL FIELD

The invention relates generally to gas turbine engine combustors and, more particularly, to a floating collar therefor.

BACKGROUND OF THE ART

Gas turbine combustors are typically provided with floating collars or seals to permit relative radial or lateral motion between the combustor and the fuel nozzle while minimizing leakage therebetween. The collar is subject to wear and heat, and is therefore cast/machined form a heat resistant material. As fuel nozzles, combustors and related components must be periodically removed for cleaning, inspection, repair and, occasionally replacement, the floating collar arrangement is provided in a manner which facilitates such removal, to thereby facilitate maintenance. Floating collar arrangements have become quite elaborate in the recent art, as designers continuously improve gas turbine efficiency. Such improvement, however, often comes at the expense of economical operation for the operator, as elaborate parts are typically more expensive to repair and replace. Accordingly, there is a need to provide a solution which addresses these and other limitations of the prior art, and in particular, there is a need to provided economical solutions to enable the emerging general aviation very small turbofan gas turbine market.

SUMMARY OF THE INVENTION

In one aspect, the present invention provides a method of providing a floating collar for a gas turbine engine combustor, the method comprising the steps of: providing an annular sheet metal blank; and bending the blank to provide a floating collar having an axial extending annular collar portion, an annular flange portion extending radially from the collar portion and a smooth transition portion between the collar and flange portions.

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
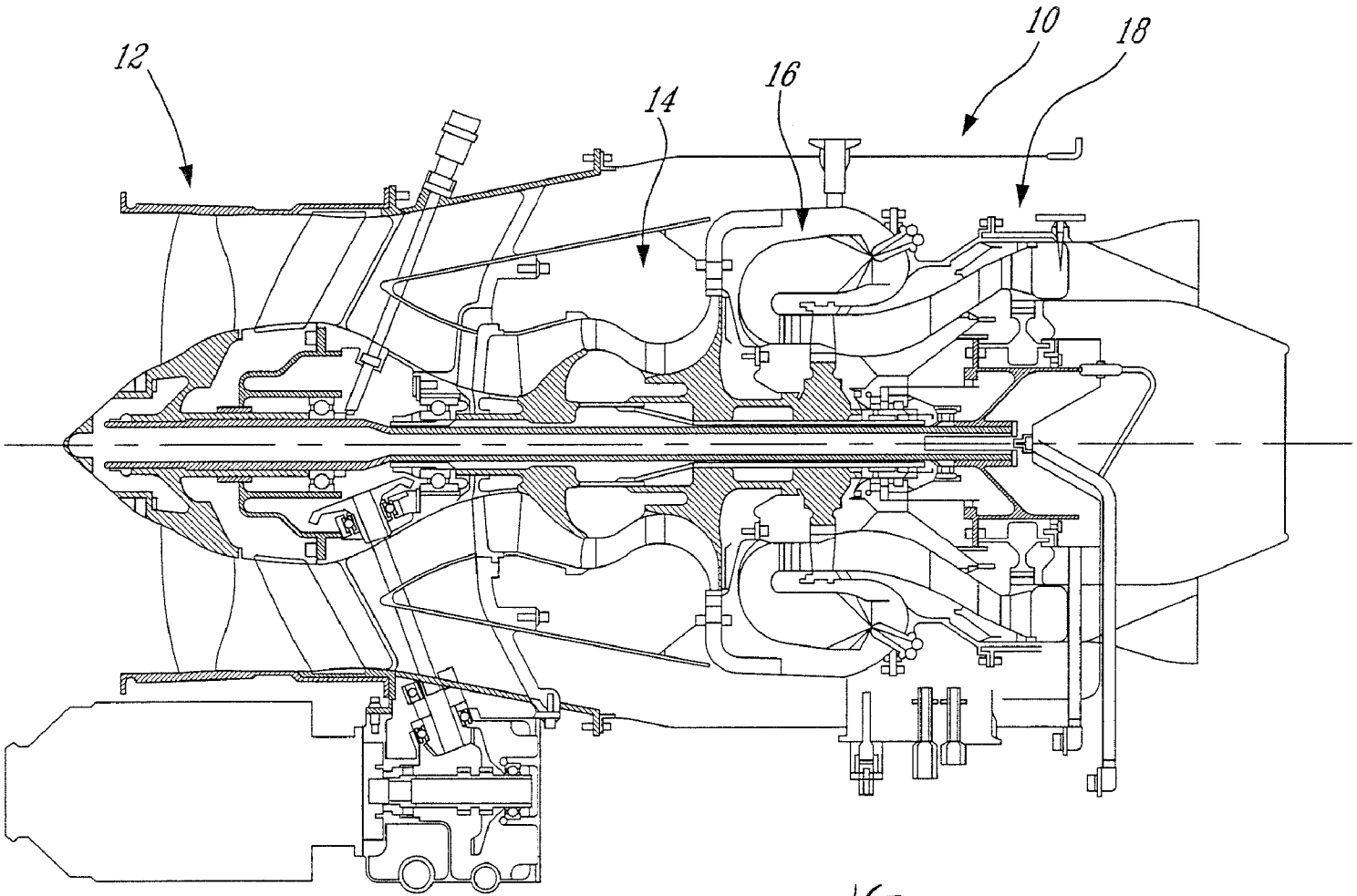
FIG. 1 is a schematic longitudinal sectional view of a turbofan gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
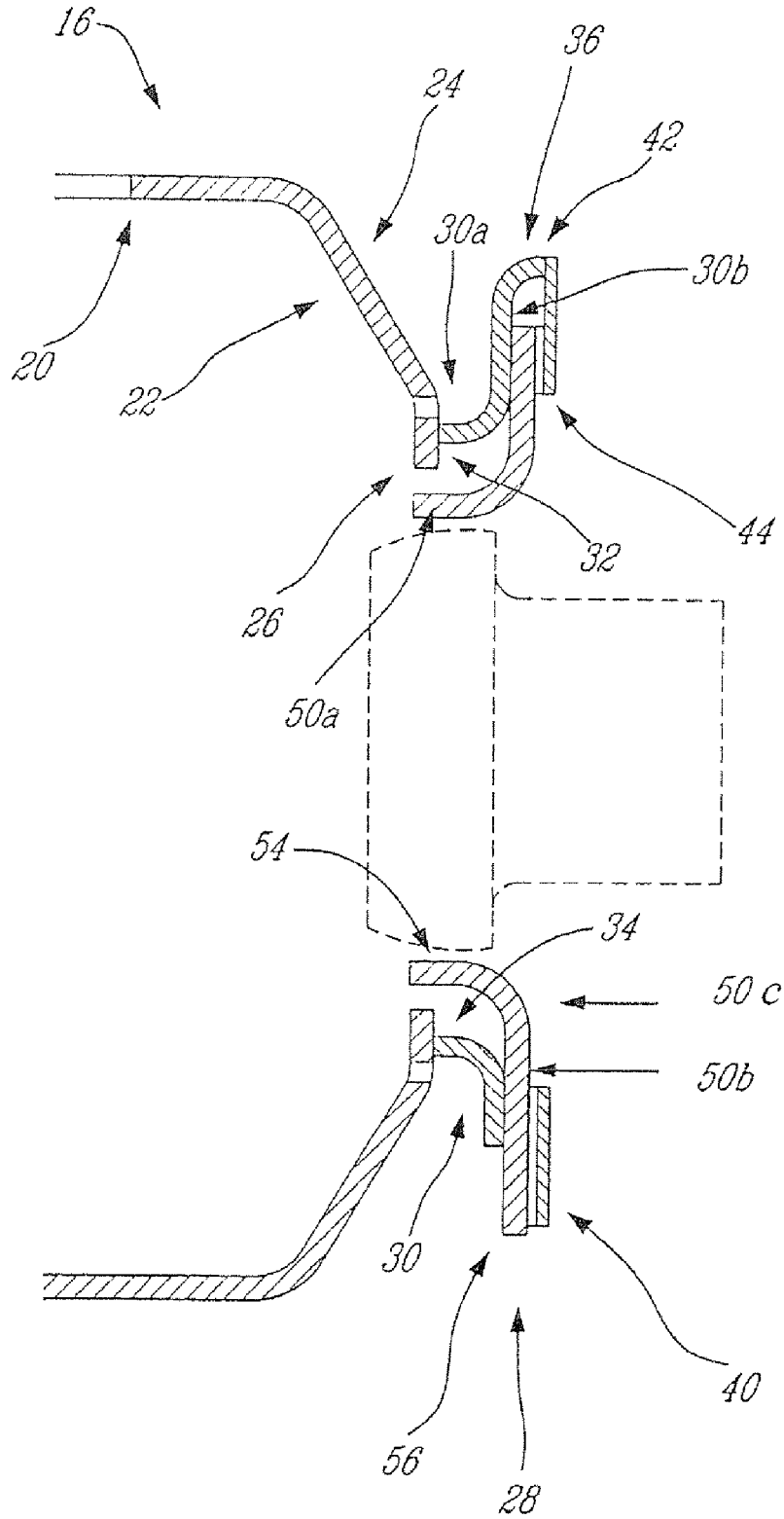
FIG. 2 is a partial sectional view of a combustor in accordance with an embodiment of the present invention.
Figure 3:
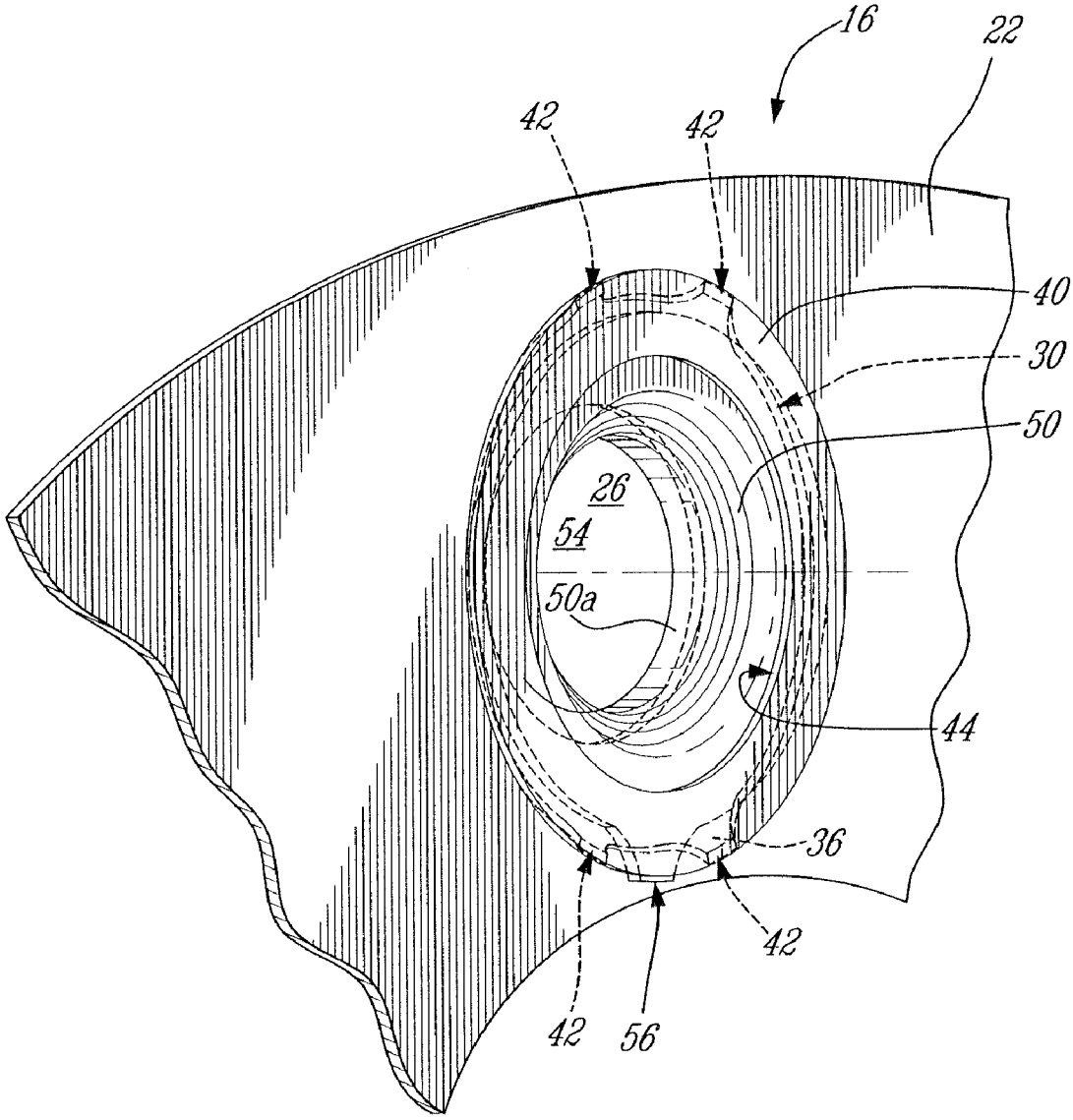
FIG. 3 is an isometric view of a portion of FIG. 2.

FIG. 2 shows an enlarged axial sectional view of a combustor 16 having a liner 20 and a dome 22 having an exterior side 24 and a central opening 26 for receiving a air swirler fuel nozzle (depicted in stippled lines in FIG. 2) of the type generally described in U.S. Pat. No. 6,289,676 or 6,082,113, for example, and which are incorporated herein by reference. A mounting arrangement 28 is provided as will now be described.

An annular mounting flange 30 is fixedly bonded, preferably by a weld 32, to the exterior side 24 of dome 22, and includes an axially-disposed annular portion 30*a*, a radially disposed annular flange portion 30*b*, both defining a central aperture 34 therein. Central aperture 44 can be aligned with dome opening 26 when mounting flange 30 is mounted on the combustor. Mounting flange 30 may also include a plurality of legs 36 as will be described further below.

An annular cap 40 is provided and fixedly bonded, preferably by a weld 42, to mounting flange 30, preferably at legs 36. Cap is provided in a spaced-apart manner relative to mounting flange 30, as will be described further below. Cap 40 has a central aperture 44 which is aligned with dome opening 26 when mounted on combustor 16 and adapted to receive the fuel nozzle therein.

A floating collar 50 is provided having a axially-disposed nozzle collar portion 50*a*, and a radially disposed annular flange portion 50*b*, both surrounding a central aperture 54, and a smooth transition 50*c* joins portions 50*a* and 50*b*. Central aperture 54 and collar portion 50*a* are provided for axially slidingly engaging a circumferential shoulder of the fuel nozzle swirler body (stippled lines in FIG. 2). Collar portion 50*a* preferably extends to, or inside, dome 22 though opening 26. Flange portion 50*b* is trapped between opposed surfaces of mounting flange 30 and cap 40, with mounting flange 30 and cap 40 being sufficiently spaced apart to permit radial (relative to the engine axis of FIG. 1) sliding motion to occur between floating collar 50 and mounting flange 30/cap 40. An anti-rotation tang 56 depends from flange portion 50*b* and is likewise trapped between adjacent mounting flange legs 36, to thereby limit the amount by which floating collar 50 may rotate relative to mounting flange 30/cap 40.

In use, the fuel nozzle air swirler (not shown) is positioned within central aperture 54 and delivers a fuel air mixture to combustor 16. As forces acting upon the fuel nozzle and the combustor tend to cause relative movement therebetween, floating collar 50 is able to displace radially with the nozzle while maintaining sealing with respect to combustor through maintaining sliding engagement with mounting flange 30 and cap 40. Welds 32 and 42 ensure that mounting flange 30 and cap 40 maintain their spaced-apart relation and thereby keep floating collar 50 trapped therebetween.

Figure 4:
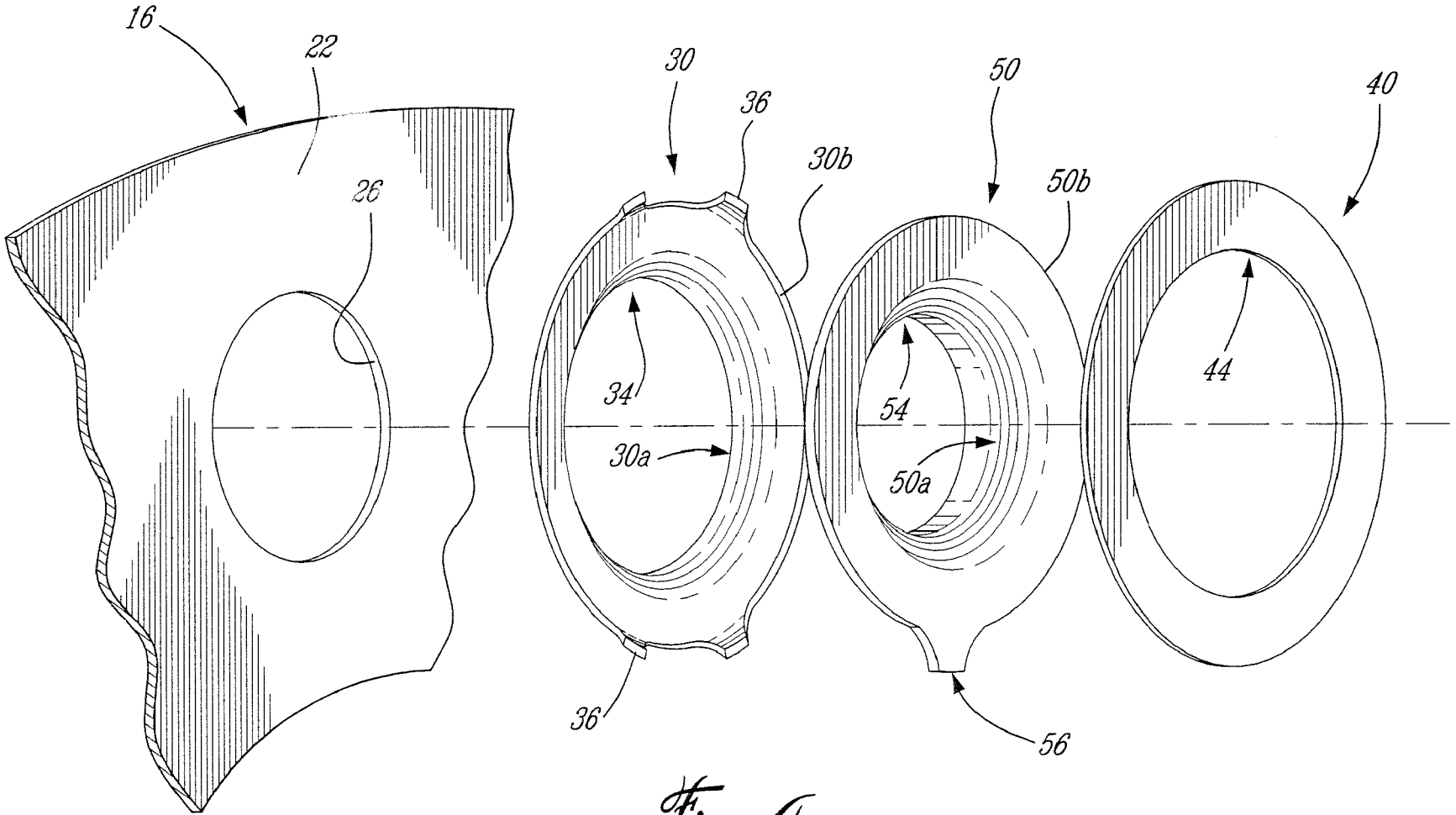
FIG. 4 is an exploded isometric view of FIG. 3.

Referring to FIG. 4, mounting arrangement 28 is assembled through a process involving at least the following steps: welding mounting flange 30 to combustor dome 22 so that the flange central opening 36 is generally aligned with dome opening 26; inserting floating collar 50 into the mounting flange 30, so that the collar portion 50*a* extends through central opening 36 and is generally aligned with dome opening 26, and preferably also so that anti-rotation tang 56 is trapped between two closely adjacent legs 36; and welding cap 40 to mounting flange 30, preferably at legs 36, to slidingly trap the floating collar between cap and the mounting flange. The order of operations may be any suitable, and need not be chronologically as described.

Mounting arrangement 28 and floating collar 50 are preferably provided from sheet metal. A simplified example process is to provide a sheet of metal, cut a blank, and perform at least one bending operation to provide the floating collar. Referring again to FIG. 2, it is evident that a sheet metal collar 50 has a continuous transition 50*c* is provided as a result of a sheet metal forming operation, such a bending, and helps strengthen the collar 50. Unlike prior art collars made by investment casting and/or machining processes (see U.S. Pat. Nos. 4,454,711, 4,322,945 and 6,497,105, for example), the present invention's use of sheet metal advantageously permits a very light weight and inexpensively-provided part, due to its simple geometry, and yet provides good performance and reliability.

Unlike the prior art, the mounting assembly of the present invention is geometrically simple, lightweight, easy to manufacture and east to assemble. Contrary to the prior art which teaches providing a high-cost device which facilitates replacement, the design and method of the present invention instead has relatively low initial cost, which assists in providing a lower-overall cost to the gas turbine engine, thereby facilitating the provision of an affordable general aviation turbofan engine, for example. As well, because the initial cost is lower, the cost of replacement may also be lowered.

The above description is meant to be exemplary only, and one skilled in the art will recognize that changes may be made to the embodiments described without departing from the scope of the invention disclosed. For example, the present invention may be applied to any gas turbine engine, and is particularly suitable for airborne gas turbine applications. The means by which flange 30 is mounted to cap 40 may be different than that described. For example legs 36 may be replaced or supplemented with a continuous or discontinuous flange or lip, and/or may extend from flange 30, cap 40 or both. The mode of anti-rotation may be any desirable. Though welding is preferred, brazing or other bonding methods may be used. Other modifications which fall within the scope of the present invention will be apparent to those skilled in the art, in light of a review of this disclosure, and such modifications are intended to fall within the equivalents accorded to the appended claims.

The invention claimed is:

1. A method of manufacturing a gas turbine engine combustor having a liner and a dome with an opening therein adapted to receive a fuel nozzle therethrough, the method comprising the steps of:

providing an annular sheet metal blank;

bending the blank towards a first direction extending along a central axis of the annular metal blank to define a floating collar having an axial extending annular collar portion, an annular flange portion extending radially from the collar portion and a continuously smooth rounded transition portion between the collar and flange portions, the continuously smooth rounded transition portion defining a radius of curvature, the annular collar portion extending axially from the flange portion towards the first direction;

providing a mounting arrangement of the dome having a mounting flange and a cap axially spaced apart, the mounting flange being fixed to an exterior of the dome adjacent the opening; and engaging the floating collar to the mounting arrangement such that the annular flange portion is trapped between opposed surfaces of the mounting flange and the cap, the mounting flange and the cap being sufficiently spaced apart to permit radial sliding motion of the floating collar therebetween, the floating collar being engaged such the collar portion extends within or is in alignment with the opening and the first direction extends through the opening toward an interior of the liner.

2. The method as defined in claim 1, further comprising forming at least one anti-rotation member on the annular flange portion.

3. The method as defined in claim 2, wherein the anti-rotation member is an anti-rotation tang extending radially outwards from the annular flange portion.

4. The method as defined in claim 1, further comprising forming the axial extending annular collar portion with a circular central aperture defined therewithin.

5. The method as defined in claim 4, further comprising forming the circular central aperture such that it is larger than a fuel nozzle swirler body adapted to be received therein and smaller than the opening in the dome.

* * * * *